US012139986B2

(12) United States Patent
Giem et al.

(10) Patent No.: US 12,139,986 B2
(45) Date of Patent: Nov. 12, 2024

(54) MILLING AND CATCHING DEVICES

(71) Applicant: Schlumberger Technology Corporation, Sugar Land, TX (US)

(72) Inventors: Gregory Giem, Houston, TX (US); Benjamin Jean Yvon Durand, Houston, TX (US); Joshua Wurtz, Houston, TX (US); Robert Kyle Wiesenborn, Richmond, TX (US); Joseph Casassa, Sugar Land, TX (US); Rodrigo Feliu, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/043,927

(22) PCT Filed: Sep. 7, 2021

(86) PCT No.: PCT/US2021/049295
§ 371 (c)(1),
(2) Date: Mar. 3, 2023

(87) PCT Pub. No.: WO2022/051720
PCT Pub. Date: Mar. 10, 2022

(65) Prior Publication Data

US 2023/0313627 A1 Oct. 5, 2023

Related U.S. Application Data

(60) Provisional application No. 63/074,784, filed on Sep. 4, 2020.

(51) Int. Cl.
*E21B 27/00* (2006.01)
*E21B 29/00* (2006.01)

(52) U.S. Cl.
CPC ..... *E21B 29/005* (2013.01); *E21B 27/00* (2013.01)

(58) Field of Classification Search
CPC ..... E21B 29/005; E21B 27/00; E21B 34/14; E21B 29/002
See application file for complete search history.

(56) References Cited

U.S. PATENT DOCUMENTS

2010/0006279 A1 1/2010 Martinez
2015/0152704 A1* 6/2015 Tunget ..... E21B 17/05 166/299

(Continued)

FOREIGN PATENT DOCUMENTS

CN 111219149 A 6/2020
WO 2018125054 A1 7/2018

OTHER PUBLICATIONS

International Preliminary Report on Patentability issued in International Patent application PCT/US2021/049295 dated Mar. 16, 2023, 7 pages.

(Continued)

*Primary Examiner* — Tara Schimpf
*Assistant Examiner* — Jennifer A Railey
(74) *Attorney, Agent, or Firm* — Jeffrey D. Frantz

(57) ABSTRACT

A milling system may be used to remove the portions of a failed valve that is blocking the wellbore. When milling a partially open valve obstructing the wellbore, the target material to be removed may not be present at the central axis of the wellbore causing the target material to not fully surround the milling bit, which may cause the bit to be deflected away from the target during milling reducing milling efficiency. The disclosed milling system may be used to mill out and capture the coupon for any downhole obstruction that does not have any material near the center axis of the wellbore. A first embodiment of the milling (Continued)

system may be configured to fully mill out material within the wellbore while a second embodiment may be used to mill out material within the wellbore and further catch the milled material or coupon.

16 Claims, 9 Drawing Sheets

(56) References Cited

U.S. PATENT DOCUMENTS

| | | | | |
|---|---|---|---|---|
| 2018/0094509 | A1* | 4/2018 | Braddick | E21B 23/01 |
| 2018/0179845 | A1* | 6/2018 | Pallin | E21B 31/107 |
| 2020/0270967 | A1* | 8/2020 | Fong | E21B 33/1293 |
| 2022/0074290 | A1* | 3/2022 | Al-Somali | F16K 1/18 |

OTHER PUBLICATIONS

International Search Report and Written Opinion issued in International Patent application PCT/US2021/049295 on Dec. 10, 2021, 13 pages.

* cited by examiner

MILLING AND CATCHING DEVICES

This application is the U.S. national phase of International Patent Application No PCT/US2021/049295, filed Sep. 7, 2021, and entitled "Milling and Catching Devices" which claims priority to, and the benefit of, U.S. Patent Application No. 63/074,784 filed Sep. 4, 2020, both of which are incorporated herein by reference in their entirety. The subject matter disclosed herein relates to milling and catching devices and, more particularly, to milling and catching devices for use with downhole intervention tools.

BACKGROUND

The subject matter disclosed herein relates to milling and catching devices and, more particularly, to milling and catching devices for use with downhole intervention tools.

Production of a wellbore may necessitate use of various valves including, but not limited to, ball valves, gate valves, or any other type of movable barrier that may be used to block the wellbore. The valve or movable barrier may fail in a position between fully open and fully closed. When a valve fails in a partially opened or closed position, portions of the valve may block the flow of wellbore fluids and may impinge the clearance needed for devices to be inserted and removed from the wellbore. A milling and catching device would allow removal of the blocking portions of the failed valve to clear the wellbore for passage of devices and wellbore fluids.

When milling a partially open valve obstructing the wellbore, the target material to be removed may not be present at the central axis of the wellbore causing the target material to not fully surround the milling bit, which may cause the bit to be deflected away from the target during milling reducing milling efficiency. For milling equipment deployed on drill pipe or coiled tubing, the system can often provide sufficient torque and force on the bit to overcome this inefficiency; however, for milling equipment deployed on wireline, the available force and torque are less and therefore the losses caused by bit deflection are difficult to overcome.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
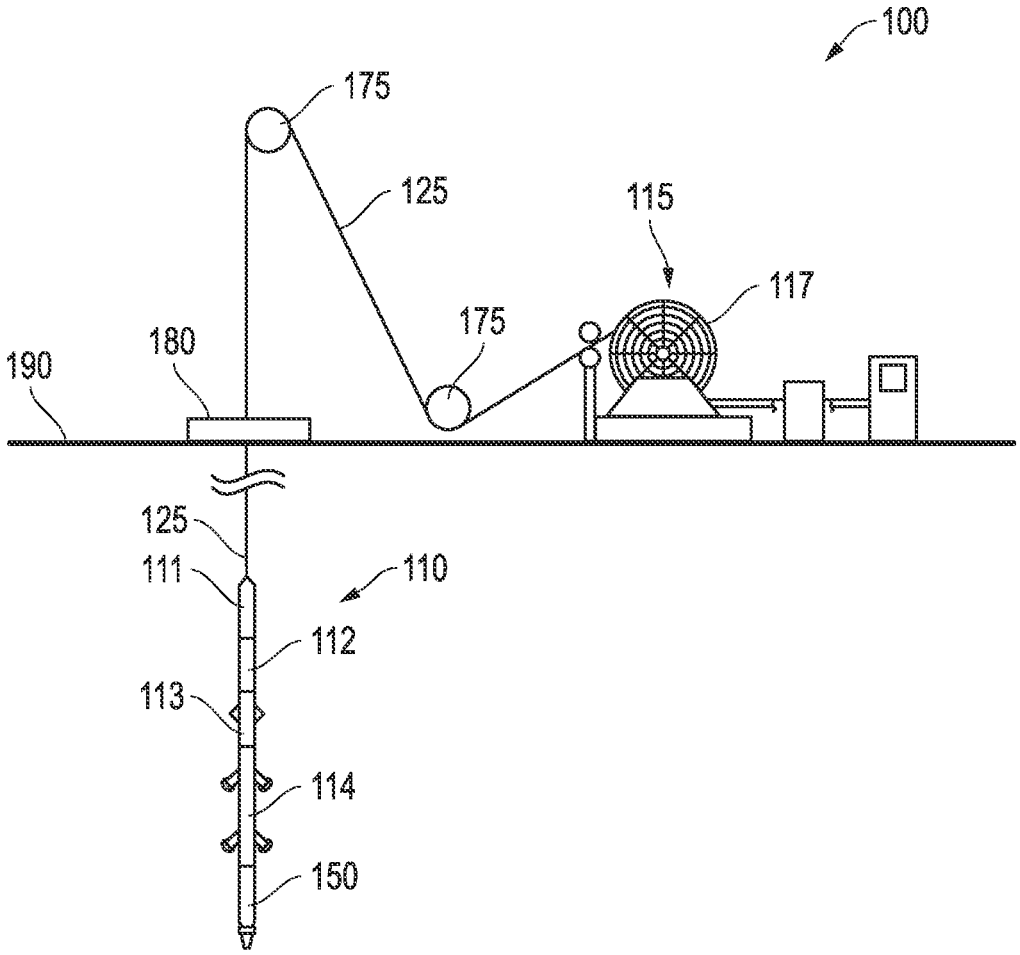
FIG. 1 is a schematic view of an embodiment of an intervention system including a milling system, in accordance with embodiments of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain examples commensurate in scope with the originally claimed subject matter are discussed below. These examples are not intended to limit the scope of the disclosure. Indeed, the present disclosure may encompass a variety of forms that may be similar to or different from the examples set forth below.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase "A based on B" is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, and/or extraction of resources. These resources may include oil, gas, water, or any other combination of elements within the ground.

Wellbores, sometimes called boreholes, may be straight or curved holes drilled into the ground from which resources may be discovered, observed, and/or extracted. Moreover, the wellbores may have horizontally drilled sections to increase production and/or efficiency. After the formation of a wellbore, well logging and production may be practiced. Well logging may include making a detailed record of the geological formations penetrated by a wellbore, and may also be practiced during creation (e.g., drilling) of the wellbore. Production may include the extraction of resources from within the wellbore.

Production of a wellbore may necessitate use of various valves or movable barriers to isolate portions of the wellbore. The valve or movable barrier may fail in a position between fully open and fully closed, which may block the flow of wellbore fluids and may impinge the clearance needed for devices to be inserted and removed from the wellbore. A milling device would allow removal of the blocking portions of the failed valve to clear the wellbore for passage of devices and wellbore fluids. Further, a catching device may also be used to collect the milled material.

Referring now to FIG. 1, a schematic view of an embodiment of an intervention system 100 is shown. The system 100 includes a downhole assembly 110 with a milling system 150 for performing a milling application in a well. A communicative conveyance line 125 is also provided. The line 125 is housed on a reel 117 that is provided to the oilfield 190 as part of an overall surface drive system, such as a winch system 115. Thus, the milling system 150 may be deployed from an oilfield surface 190 past sheaves 175 and a well head 180 and into a well for the milling operation. The surface drive system 115 comprises that equipment that controls deployment of the line 125 and/or creates motion for the deployment of the line 125.

The above referenced conveyance line 125 allows for a convenient manner of tool retrieval once the downhole milling application has been completed. Specifically, the line 125 may be unwound from the reel 117 of the surface drive system or winch system 115 to deploy the milling system 150 into the well with the reel 117 later rewound for retrieval thereof along with the milling system 150 once the application is complete. While the depicted line 125 may be a wireline, coiled tubing or other line types may be utilized and the surface drive system 115 may comprise an injector or other appropriate surface equipment such as, but not limited to, surface equipment for pumping a fluid into a tubular or the well to enable the pumped fluid to convey the milling system 150 into the well.

The downhole assembly 110 may acquire readings or measurements that lead to adjustments in the deployment. Specifically, as noted above, wireline 125 includes a communicative capacity. Therefore, sensors 111, 112 of the downhole assembly 110 may be used to acquire data during the deployment and milling application.

In the embodiment shown, the conveyance line 125 is deployed through a well by way of a tractor 114 as alluded to above along with the winch system 115 and its unwinding reel 117. In an embodiment where coiled tubing is utilized in place of the depicted wireline 125, an injector may be utilized as part of the winch system 115.

Figure 2:
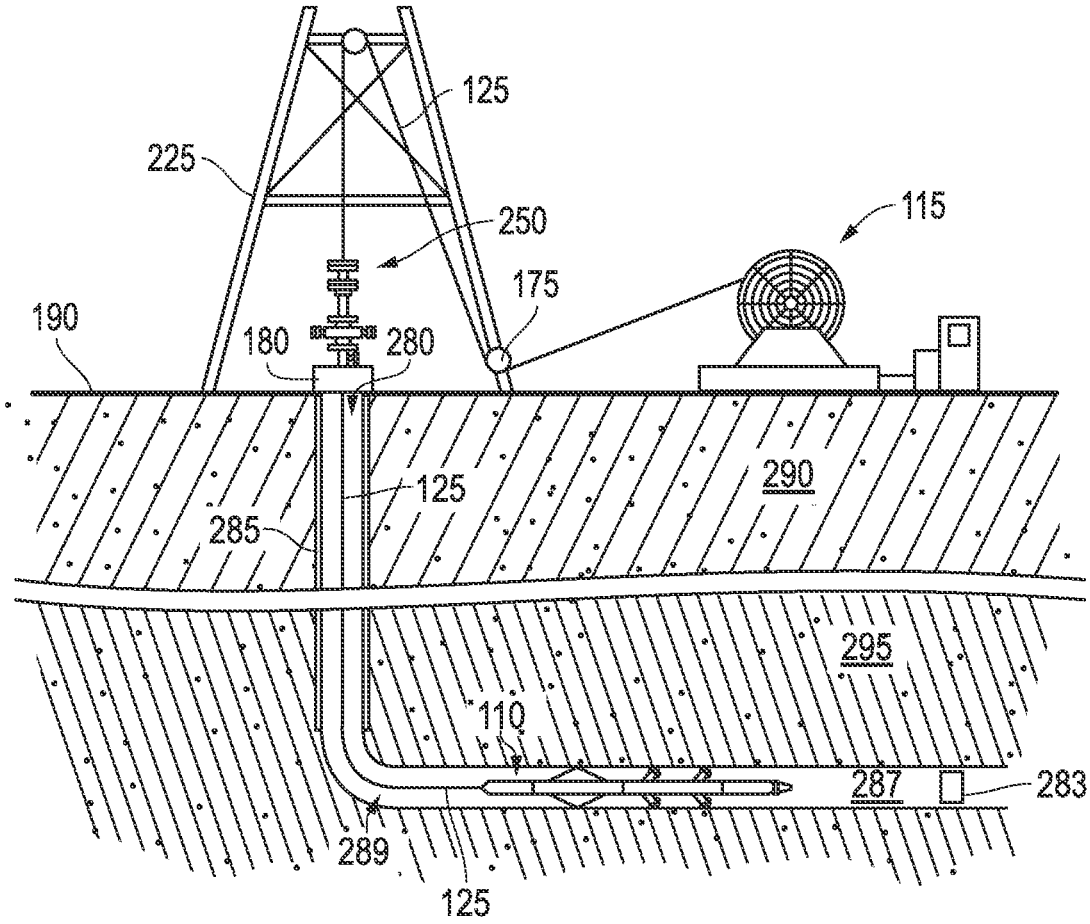
FIG. 2 is an overview of an oilfield with a well accommodating a tractor-based interventional tool and conveyance of the milling system of FIG. 1.

Referring now to FIG. 2, an overview of an oilfield is shown with a well 280 including a valve 283 therein and accommodating the tractor-driven downhole assembly 110 of FIG. 1 along with the mode of conveyance therefor (i.e., a wireline cable 125). In this view, the downhole assembly 110 is shown advancing through a horizontal portion 287 of the well 280 toward the valve 283. More specifically, the well 280 includes a vertical section defined by casing 285 that traverses several thousand feet below the oilfield surface 190 across multiple formation layers 290, 295. In the embodiment shown, a conventional rig 225 and pressure control equipment 250 are provided to aid in a tractor-driven wireline conveyance as indicated. However, where coiled tubing is utilized, an injector may be disposed over the well head 180. Further, as also indicated above, alternative types of conveyances such as slickline or drill pipe may be utilized.

Continuing with reference to the embodiment of FIG. 2, the well 280 transitions into the noted horizontal portion 287 at an elbow 289 where the vertical portion and casing 285 terminate. For example, this type of architecture may be directed at recovering hydrocarbons from the lower formation layer 295 at the location of the horizontal portion 287. Thus, as a matter of completions, maintenance or monitoring, the valve 283 or other movable barrier may be located in other locations of the well 280.

Figure 3:
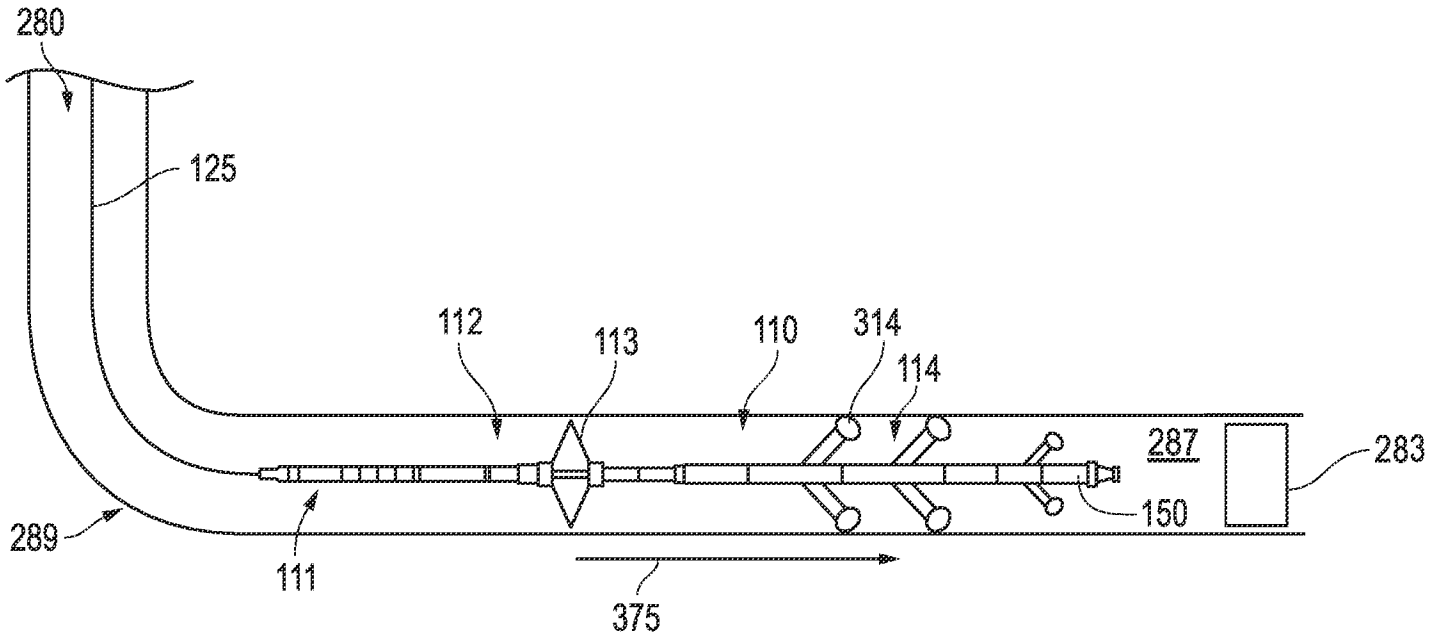
FIG. 3 is an enlarged view of the milling system of FIG. 2 located within a horizontal section of the well.

Referring now to FIG. 3, with added reference to FIG. 2, an enlarged view of the downhole assembly 110 and conveyance line 125 are depicted centralized by a centralizer 113 within the horizontal portion 287 of the well 280. The centralizer 113 may aid in centering the milling system 150, and in other embodiments may be integrated into a rotary module that spins the milling system 150. For sake of illustration, the assembly 110 is described as moving in a downhole direction (arrow 375) toward valve 283. As shown, the tractor 114 of the assembly is outfitted with rollers 314 or wheels that serve as an aid to downhole advancement.

Figure 4A:
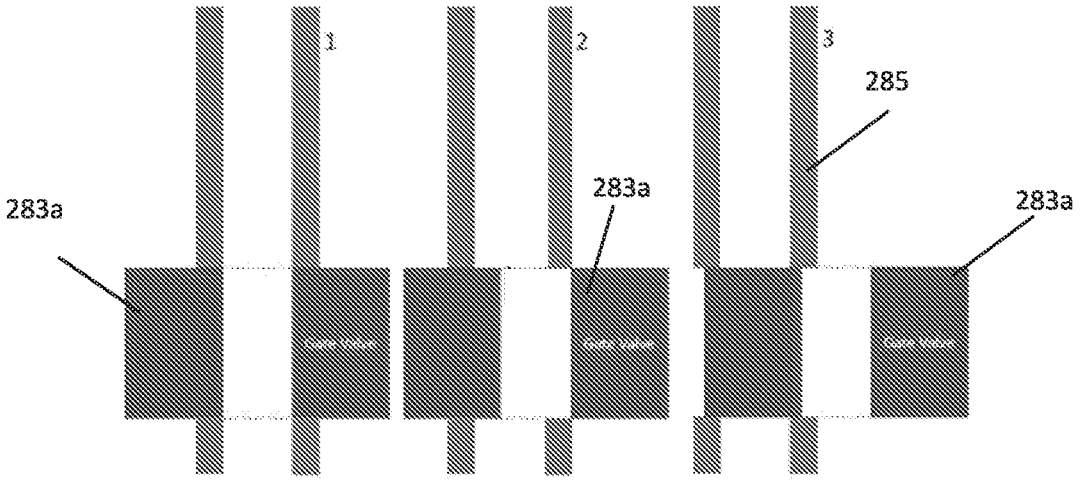
FIGS. 4A-4C depict example gate valves and ball valves while closed, open, and partially open in varying amounts.
Figure 4B:
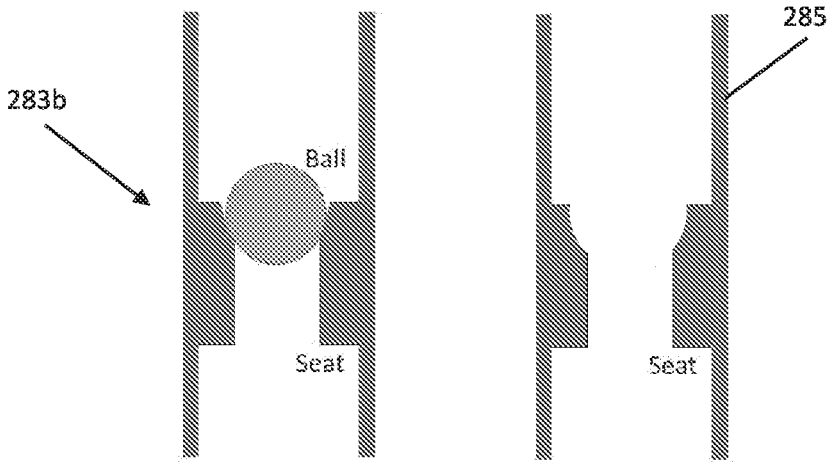
Figure 4C:
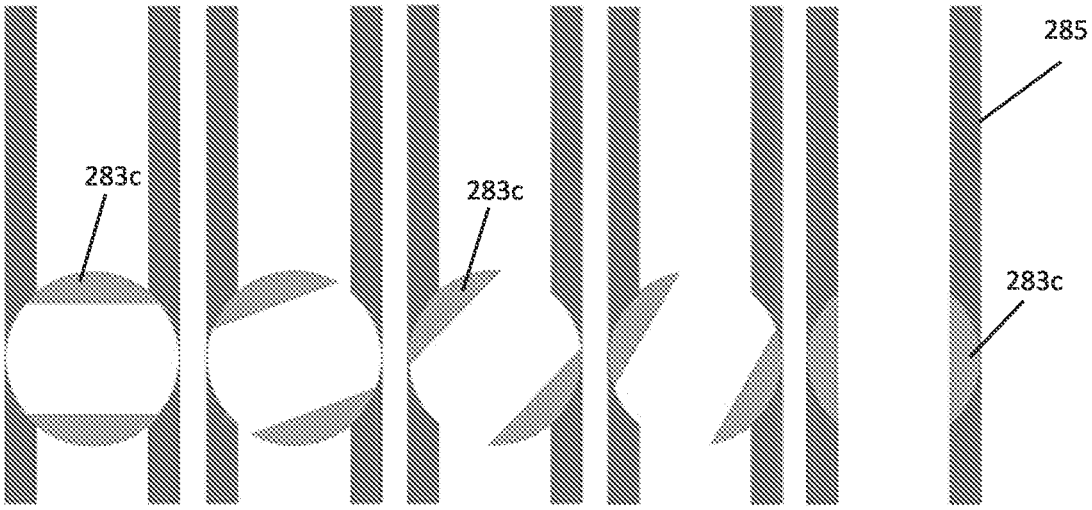
Figure 4D:
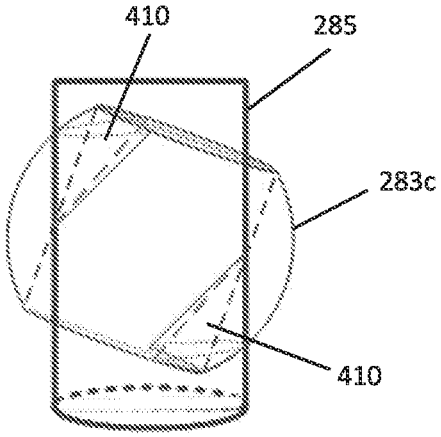
FIG. 4D show a ball valve oriented in a partially open configuration with portions that may be removed via the milling system of FIGS. 1-3.

Referring now to FIGS. 4A-4D, the valve 283 may be any valve known in the art including, but not limited to, gate valves 283*a* (FIG. 4A), ball valves 283*b*, 283*c* (FIGS. 4B, 4C), or any other type of movable barrier that may be used to block the wellbore. FIG. 4A shows a gate valve 283*a* in an open position (1), a partially open position (2), and a closed position (3). If the gate valve 283*a* fails in the partially open position (2) or the closed position (3), the portion of gate valve 283*a* falling inside the casing 285 may need to be milled away. FIG. 4B shows a ball valve 283*b* with a seated ball (left side) and an empty ball seat (right side). The ball and/or empty ball seat may need to be milled away. FIG. 4C shows ball valve 283*c* in various positions between completely closed (left side) to partially open with an increasing opening to completely open (right side), where the ball valve may fail while closed, open, or in any degree of partial opening. Depending on the amount the ball valve 283*c* is open, the amount of material falling inside the casing 285 that may need to be milled away or removed will vary. FIG. 4D shows the portions of ball valve 283*c* that would be removed in the milling process to clear the casing or wellbore 285. The coupon or portion or remnant of the valve 283*c* that is removed is wedge shaped in the present embodiment but may be any shape depending on the amount of material blocking the casing or wellbore 285.

Figure 5:
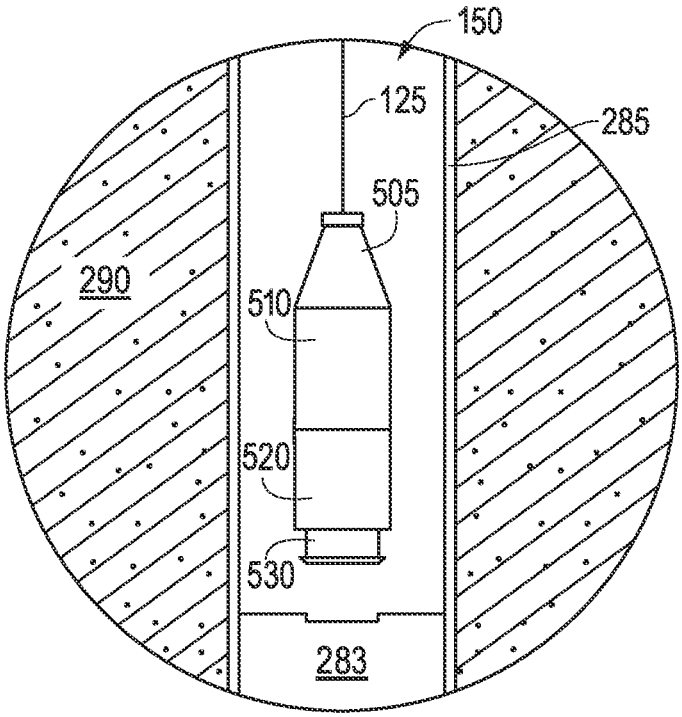
FIG. 5 is a view of an embodiment of the milling system of FIGS. 1-3 having a milling bit.

FIG. 5 shows an embodiment of the milling system 150 comprising an electronics section 505 used to control the tools and actuators, an anchor and pusher section 510, which provides the weight on bit (WOB) for milling through downhole material and reacts the milling torque, a rotary tool 520, which spins a milling bit to create torque, and a milling bit 530, which mills through the blocking portions of the failed valve 283. Milling system 150 may be used to mill out and capture the coupon for any downhole obstruction that does not have any material near the center axis of the wellbore.

Figure 6:
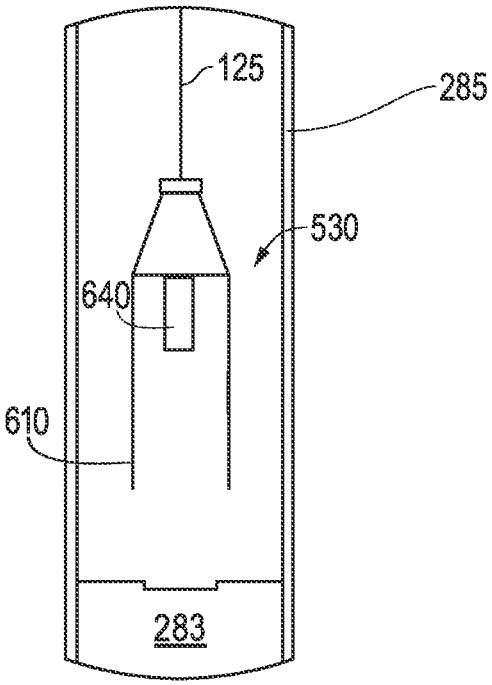
FIG. 6 is a detailed view of the milling bit of FIG. 5 having an annular cutter and a central body.

FIG. 6 shows the milling bit 530 of FIG. 5, which comprises an annular cutter 610 and a central body 640 disposed within the annular cutter 610. A first embodiment of central body 640, shown in further detail in FIG. 7, may be configured to fully mill out material (e.g., valve 283) within the wellbore 285. Central body 640 comprises an internal milling device 710. The internal milling device 710 may further comprise replaceable cutting inserts 720 or may include cutting structures machined directly into the body 640 of the milling device itself.

A lower end of the internal milling device 710 may also include an end mill 730 for plunging into target 283 with solid material near the center of the bit (i.e., the central axis of the wellbore). The specific configuration of the internal milling device 710 may include a variety of different shapes and use a variety of cutting structures 720 depending on the shape and material of the milling target 283. Regardless of configuration, the radial force generated by cutting on one side of the internal milling device 710 is reacted by an opposite radial force on the annular cutter 610. To aid in starting the cut at the center of the target 283, the internal milling device 710 is recessed within the leading edge 615 of the annular cutter 610 so the annular cutter 610 will machine a locating pocket before the internal milling device 710 contacts the target 283. For a spherical target, the annular cutter 610 may tend to self-centralize so that radial reaction force on the annular cutter 610 begins with the radial component of the contact force and then transitions to the same behavior as a flat target once a locating pocket has been milled. Compared to a milling bit without a surrounding annular cutter, this embodiment of the invention improves force on the cutter and better maintains the initial milling trajectory.

The internal milling device 710 and the annular cutter 610 may be rigidly connected at 750 and thus rotate together. The milling bit 530 (FIG. 6) is connected to the rotary section 520 (FIG. 5) with an attachment feature disposed at an upper end of central body 640. The milling bit may also contain holes 770 for capturing milling cuttings within the internal milling device 710, and channels or grooves for guiding cuttings toward the holes 770. The annular cutter 610 may also contain holes for allowing cuttings that are not captured to exit the milling bit 530. In one or more embodiments the annular cutter 610 may be arranged as an outer centralizer or sleeve and can be used to provide centralization, target alignment, target milling torque reaction, or combinations thereof. In one or more embodiments the annular cutter 610 may be connected with the internal milling device 710 such that the internal milling device 710 rotates relative to the annular cutter 610. For example, the internal milling device 710 and the annular cutter 610 may be connected using a bearing joint or other now known or future known rotating joints. In one or more embodiments the annular cutter 610 can be configured to move axially as the milling target 283 is milled. In this embodiment, the internal milling device 710 can rotate relative to the annular cutter 610 or the annular cutter 610 and the internal milling device 710 can rotate together. In one or more embodiments the annular cutter 610 does not rotate relative to the internal milling device 710, and the internal milling device 710 is configured to mill a portion of the milling target 283 as the internal milling device 710 moves axially in the direction of the milling. For example, the annular cutter 610 can be connected to the central body 640 using a joint that provides radial support and allows movement in the axial direction such as journal bearing or the like. In one embodiment during operation the annular cutter 610 will move axially relative to the internal milling device 710.

Figure 8:
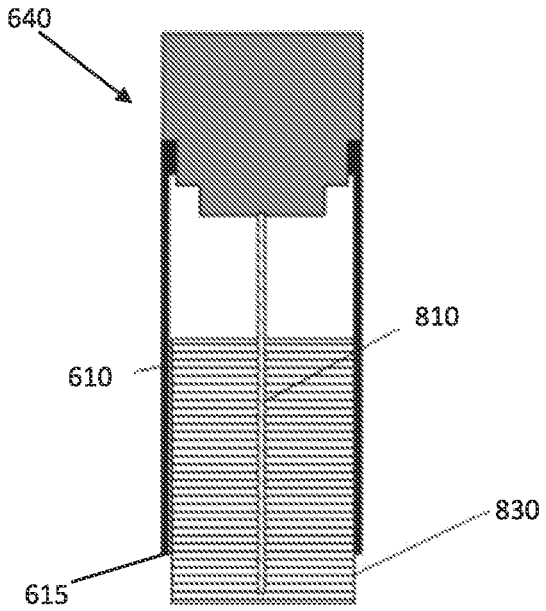
FIG. 8 is a schematic view of an alternative embodiment of the central body of FIG. 6 having a catching device.

FIG. 8 shows a second embodiment of central body 640 of FIG. 6, which may be used to mill out material (e.g., valve 283) within the wellbore 285 and further catch the milled material or coupon 410 (see FIG. 4D). Central body 640 comprises an internal shaft 810 and a catching device 830. The internal shaft 810 can be either solid or flexible in the radial direction. The internal shaft 810 and the annular cutter 610 can be either rigidly attached or coupled to one another to transmit torque while allowing independent axial motion. In the present embodiment, the internal shaft 810 is connected to the catching device 830, which comprises a cylindrical brush. The brush 830 comprises circumferentially distributed bristles which have some stiffness. The brush 830 may be positioned or be extended beyond the leading edge 615 at lower end of the annular cutter 610 to facilitate capture of lower coupon material. The bristles of the brush 830 may be biased in the axial direction and/or the tangential direction to provide a low stiffness while passing into the opened valve 283 and high stiffness in the opposite direction. In an embodiment, the brush 830 bristles may be biased with the free ends axially away from the direction of milling advancement and tangentially away from the direction of milling rotation. When a wedge-shaped coupon 410 (FIG. 4D) is fully cut from the valve 283 by the annular cutter 610, the bristles of the brush 830 will push the coupon 410 against an inner diameter of the annular cutter 610 and prevent the coupon 410 from falling back down through the center of the annular cutter 610.

Figure 9:
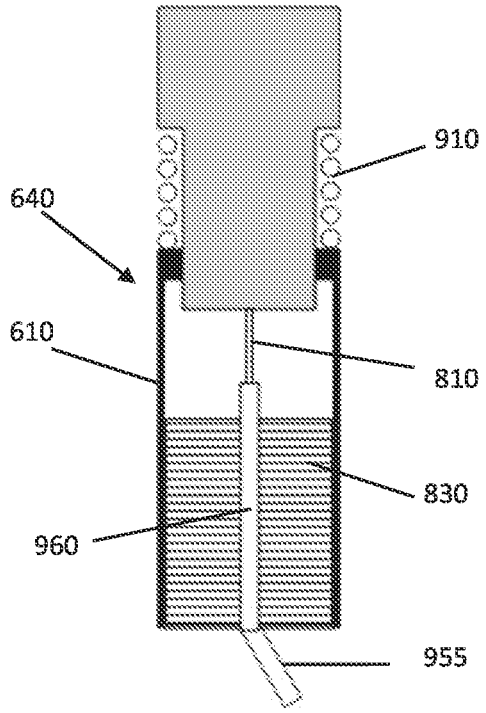
FIG. 9 is a schematic view of an alternative embodiment of the annular cutter comprising a spring and the central body having a hole finding feature.

FIG. 9 shows an alternative embodiment of central body 640, which further comprises a spring 910 on the annular cutter 610 for biasing the relative axial position of the annular cutter 610 and internal shaft 810. The catching device 830 may be made of any suitable material and have any suitable configuration that allows the catching device 830 to pass through the milling target 283 and then expand once passed through to the opposite side of the milling target 283 with a large expansion ratio.

In the present embodiment, internal shaft 810 further comprises a flexible shaft 960 with catching device 830 and a hole finder feature 955 at a lower end of the flexible shaft 960. The hole finder feature 955 assists the catching device 830 with flexible shaft 960 to enter the valve 283 and pass through the milling target 283 and then expand once passed through to the opposite side of the milling target 283. In the present embodiment, the hole finder feature 955 comprises an angled tip that rotates with the flexible shaft 960. The flexible shaft 960 may be made of any suitable material and have any suitable configuration that allows the flexible shaft 960 to be biased to a nominally centered position with respect to the annular cutter 610. When the angled tip 955 contacts the valve surface 283, the flexible shaft 960 allows the tip 955 to deflect radially while continuing to rotate with the shaft 960 until it is aligned with the hole in a partially opened valve 283. When the angled tip 955 aligns with the hole the biasing behavior causes the angled tip 955 to move back toward the nominally centered position and enter into the hole. Because the internal hole surface is nominally perpendicular to the direction of rotation, the angled tip 955 is prevented from leaving the hole and the flexible shaft 960 accommodates some rotating-bending behavior. In an alternative embodiment, the hole finder feature 955 may comprise a tapered ring mounted on the flexible shaft 960. A tapered ring hole finder may be well suited for use with a ball valve, which creates a radial force when the tapered ring contacts the spherical surface of the ball valve. The tapered ring hole finder behaves in a similar manner as the angled tip hole finder 955.

Figure 10:
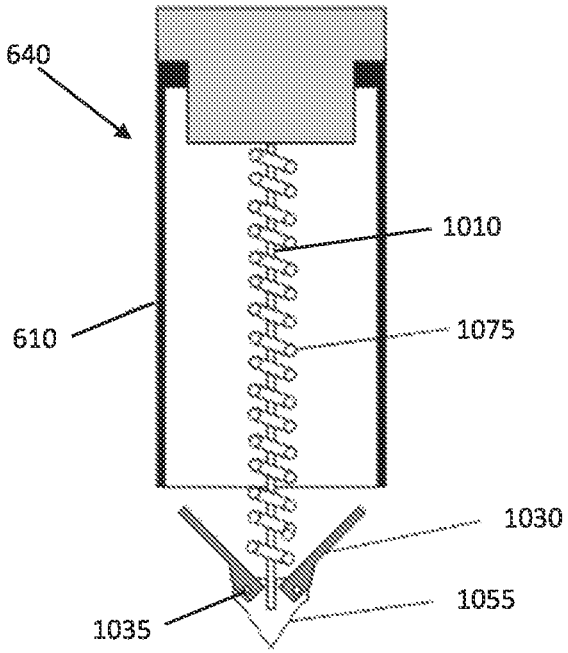
FIG. 10 is a schematic view of an alternative catching device and an alternative hole finder feature.

FIG. 10 shows an alternative embodiment of central body 640, where a hole finder feature comprises a tapered ring 1055 and an internal shaft 1010 further includes a spring 1075 to provide high stiffness in one axial direction and low stiffness in the opposite axial direction. The present embodiment further includes an alternative catching device 1030, which are flappers coupled to the tapered ring 1055 with hinges 1035. The flappers 1030 may be allowed to collapse upward to pass through the valve 283 (FIG. 4D) but may be prevented from collapsing downward to provide for catching the coupon 410. The flappers 1030 may also be biased in the open direction using at least one spring.

Figure 11:
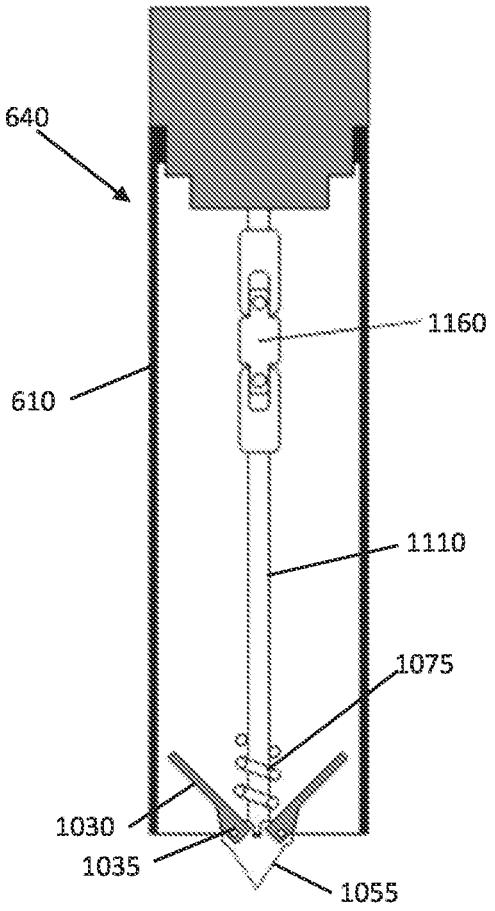
FIG. 11 is a schematic view of an alternative embodiment of the central body having universal joints.

FIG. 11 shows an alternative embodiment of central body 640 including the tapered ring hole finder feature 1055 and where an internal shaft 1110 further includes spring 1075. In the present embodiment, the internal shaft 1110 is a flexible shaft that is a segmented solid shaft connected by at least two universal joints 1160. The present embodiment further includes flappers 1030 to catch any milled coupons that are coupled to the tapered ring 1055 with hinges 1035.

Figure 12:
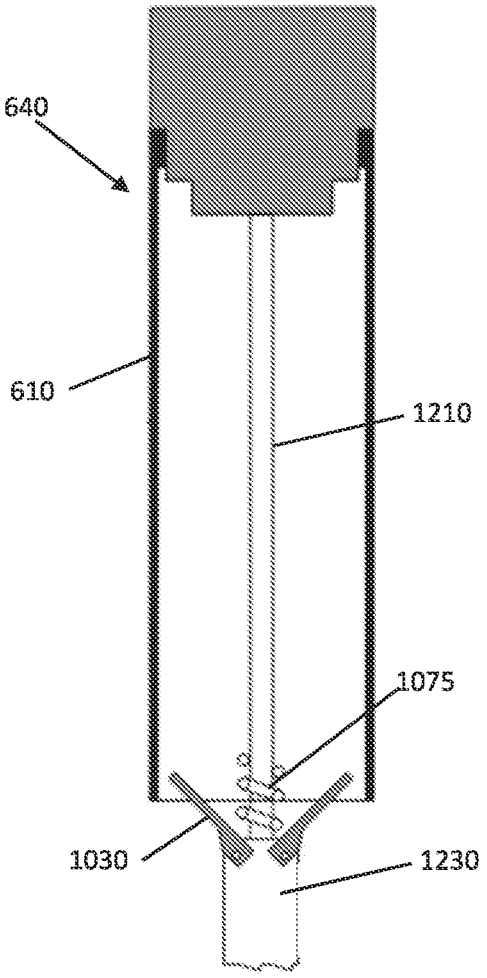
FIG. 12 is a schematic view of an alternative embodiment of the central body configured to both mill and catch milling cuttings.

FIG. 12 shows an alternative embodiment wherein central body 640 is configured to both mill and catch the coupon 410 (FIG. 4D). A hole finder feature is replaced by a milling bit 1230 at a lower end of internal shaft 1210. In the present embodiment, internal shaft 1210 may also include spring 1075. Milling bit 1230 is configured to remove material only in the center of the valve 283 (FIG. 4D), after which the catching device 1030 (e.g., flappers) may pass through the hole created in the valve by the milling bit 1230.

Figure 13A:
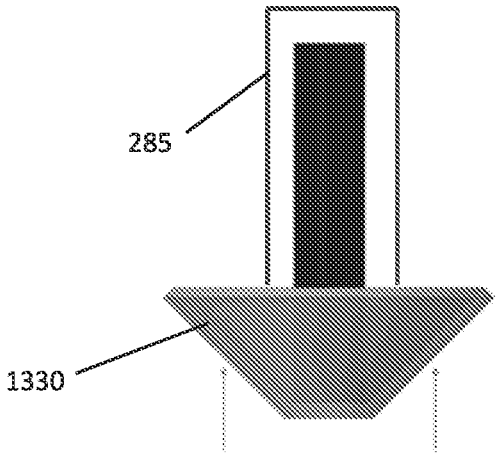
FIGS. 13A and 13B are schematic views of an alternative embodiment of a catching device shown in expanded (FIG. 13A) and collapsed (FIG. 13B) configurations.
Figure 13B:
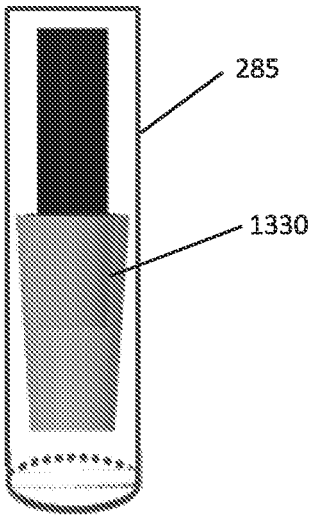

FIGS. 13A and 13B show an alternative embodiment of a catching device 1330, which may be used with any of the above disclosed internal shafts, 810, 1010, 1110, 1210. Catching device 1330 may be a formed cup that is configured to collapse in one direction but to resist inverting in the opposite direction. The catching device 1330 could be made from any suitable material including, but not limited to, an elastomer and sheet metal that would allow the catching device 1330 to collapse in one direction when being pushed through a restriction as shown in FIG. 13B and then expand again once through the restriction as shown in FIG. 13A. If sheet metal is used for the catching device 1330, the sheet metal may be corrugated to allow it to collapse.

Figure 7:
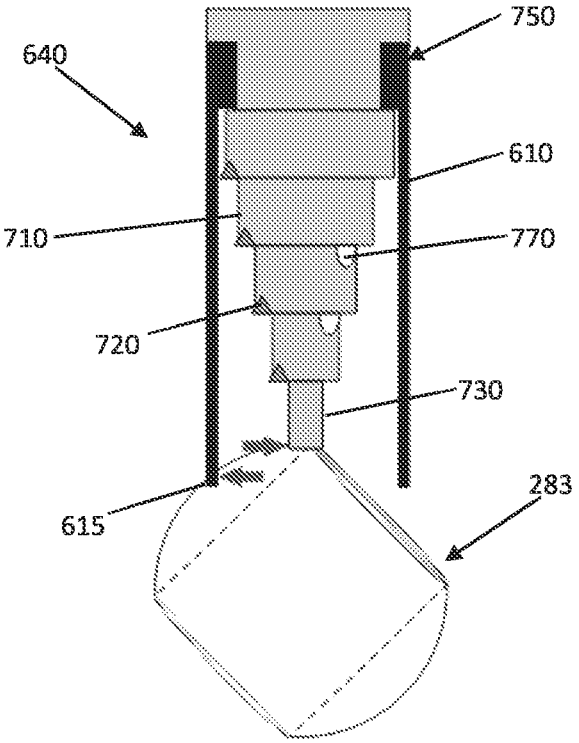
FIG. 7 is a schematic view of an embodiment of the central body of FIG. 6.

In operation, the downhole assembly 110 is run in hole to the appropriate depth. The rotary section 520 (FIG. 5) is started from the control at surface. The rotary section 520 spins the annular cutter 610 (FIG. 6), which includes a central body 640 having one of the embodiments described in this invention or a variation thereof. The pusher section 510 (FIG. 5) advances the milling bit 530 into the target 283 (FIG. 4D). As the material is milled, the downhole assembly 110 moves downhole as material is removed from the target. For embodiments using a central body configured for catching the coupon 410 (FIG. 4D), the catching device 810, 1030, 1330 is positioned ahead of the annular cutter 610 so the coupon is retained before the coupon is separated from the base material of the target. For embodiments using a central body configured for full bore material removal, the annular cutter 610 reacts the radial force generated by the internal milling device 710 (FIG. 7). Subsequent milling operations may be performed after this first one is completed where the process is repeated, but the subsequent milling cuttings pushes the previous milling cuttings further up into the internal milling device 710, where milling debris may be retained inside the milling bit 530 and the downhole assembly 110 can be brought back to surface.

In an embodiment, the catching mechanism could be made from any suitable flexible material including, but not limited to, an elastomer to accomplish the same objective.

In an embodiment, the catching mechanism could be used in conjunction with another catching mechanism or combined into one piece.

In an embodiment, the catching mechanism may be made from any number of flapper arms.

In an embodiment, the springs holding the flapper arms open may be mounted in a variety of ways, including internal or external bowsprings.

In an embodiment, the internal shaft may be long enough that the catching mechanism extends below the valve before milling commences.

In an embodiment, the catching mechanism may be configured with intentional weak points so that the catching mechanism inverts or otherwise breaks without leaving any parts in the well to enable the downhole assembly to pull out of the wellbore before the milling operation is complete.

In an embodiment, the catching mechanism may use a more complicated linkage to provide structural support to the catching mechanism while still allowing the catching mechanism to fold inward.

In an embodiment, the bottom of the catching mechanism may use an integrated hole finder feature to increase or maximize the likelihood the catching mechanism will make its way through the partially open valve.

In an embodiment, the integrated hole finder feature may work by slowly rotating the milling bit while tractoring down or relaxing the conveyance.

In an embodiment, the catching mechanism may be opened actively instead of passively by integrating a screw or spring-loaded release mechanism to open only after the milling bit rotates.

In an embodiment, the ends of the catching mechanism flapper arms may have integrated features to minimize the chance of catching on restrictions while pulling out of the wellbore.

In an embodiment, the catching mechanism may be used in other milling operations in addition to milling through partially open valves.

In an embodiment, the catching mechanism may be used for downhole retaining/capturing in other applications in addition to milling.

While the present disclosure may be susceptible to various modifications and alternative forms, specific embodiments have been shown by way of example in the drawings and have been described in detail herein. However, it should be understood that the present disclosure is not intended to be limited to the particular forms disclosed. For example, while some embodiments described herein contain specific combinations of milling and catching systems, other combinations may also be possible. Rather, the present disclosure is intended to cover all modifications, equivalents, and alternatives falling within the spirit and scope of the present disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A milling device comprising:

an annular cutter configured to cut millings cuttings from an obstruction; and a central body disposed within the annular cutter, wherein the central body comprises a catching device and an internal milling device, wherein the catching device comprises holes for capturing the milling cuttings within the internal milling device.

2. The milling device of claim 1, wherein the annular cutter is connected to the central body using a connection allowing the central body to rotate relative to the annular cutter.

3. The milling device of claim 2, wherein the annular cutter is configured to move axially.

4. The milling device of claim 2, wherein the annular cutter is used to provide centralization, target alignment, target milling torque reaction, or a combination thereof.

5. The milling device of claim 2, wherein the internal milling device is configured to mill a portion of the obstruction as the internal milling device moves axially in a direction of milling.

6. A milling device comprising:

an annular cutter configured to cut millings cuttings from an obstruction; and a central body disposed within the annular cutter, wherein the central body comprises a catching device, wherein the central body terminates at an end having a hole finder feature, wherein the catching device terminates at the end having the hole finder feature, wherein the central body comprises an internal shaft extending through the annular cutter to the catching device and the hole finder feature, and wherein a spring is disposed about the internal shaft inside of the annular cutter.

7. The milling device of claim 6, wherein the catching device is disposed at an end of the internal shaft.

8. The milling device of claim 7, wherein the internal shaft comprises a flexible shaft, and the hole finder feature is disposed at the end of the internal shaft.

9. The milling device of claim 8, wherein the hole finder feature comprises an angled tip that rotates with the flexible shaft.

10. The milling device of claim 8, wherein the hole finder feature comprises a tapered ring mounted on the end of the internal shaft.

11. The milling device of claim 6, wherein the catching device comprises flapper arms.

12. The milling device of claim 6, wherein the catching device comprises a brush having a plurality of radial bristles coupled to the internal shaft of the central body.

13. The milling device of claim 6, wherein the catching device comprises a plurality of flapper arms coupled to hinges, and each of the hinges has an axis of rotation crosswise to a central axis of the central body.

14. The milling device of claim 6, wherein the hole finder feature comprises an angled tip or a tapered ring.

15. The milling device of claim 6, wherein the catching device and the hole finder feature are directly coupled together.

16. The milling device of claim 6, wherein the catching device comprises a brush with distributed bristles biased to provide greater stiffness in a first direction and lesser stiffness in another direction opposite the first direction.

* * * * *